US009362608B1

(12) United States Patent
Lee et al.

(10) Patent No.: US 9,362,608 B1
(45) Date of Patent: Jun. 7, 2016

(54) MULTICHANNEL RELAY ASSEMBLY WITH IN LINE MEMS SWITCHES

(71) Applicant: GENERAL ELECTRIC COMPANY, Schenectady, NY (US)

(72) Inventors: Yongjae Lee, Latham, NY (US); Marco Francesco Aimi, Niskayuna, NY (US); Glenn Scott Claydon, Wynantskill, NY (US); Christopher Fred Keimel, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 14/558,990

(22) Filed: Dec. 3, 2014

(51) Int. Cl.
*H01P 5/18* (2006.01)
*H01P 1/10* (2006.01)

(52) U.S. Cl.
CPC .. *H01P 5/18* (2013.01); *H01P 1/10* (2013.01); *H01P 5/184* (2013.01)

(58) Field of Classification Search
CPC ..... H01L 41/0825
USPC ..... 257/414
See application file for complete search history.

(56) References Cited

U.S. PATENT DOCUMENTS 6,493,482 B1 12/2002 Al-Hemyari et al.
7,602,261 B2 10/2009 Chou et al.
7,692,521 B1 4/2010 Cohn
7,741,936 B1 6/2010 Weller et al.
7,764,861 B2 7/2010 Sangawa et al.
7,821,466 B2 10/2010 Lempkowski
7,928,333 B2 4/2011 Wang et al.
8,354,899 B2 1/2013 Keimel et al.

(Continued)

FOREIGN PATENT DOCUMENTS

EP 1400823 A1 3/2004
EP 2398028 A2 12/2011

(Continued)

OTHER PUBLICATIONS

G. M. Rebeiz et al., "The Search for a Reliable MEMS Switch," IEEE Microwave Magazine, vol. 14, Issue 1, Jan. 28, 2013, pp. 57-67.

(Continued)

*Primary Examiner* — Marc Armand
(74) *Attorney, Agent, or Firm* — Joseph J. Christian

(57) ABSTRACT

An ohmic RF MEMS relay includes a substrate with a capacitive coupling, $C_{sub}$; two actuating elements electrically coupled in series, so as to define a channel, wherein the actuating elements are configured to be independently actuated or simultaneously operated. The actuating elements have their own capacitive coupling, $C_{gap}$; a midpoint on the channel is in electrical communication with the actuating elements; and an anchor mechanically coupled to the substrate and supporting at least one of the actuating elements. Also, an ohmic RF MEMS relay that includes an input port; a plurality of first MEMS switches that make up a first switching group in electrical communication with the input port, thereby defining a plurality of channels each leading from each of the MEMS switches; and at least one outlet port along each of the channels distal from the first switching group and in electrical communication with the input port.

46 Claims, 6 Drawing Sheets

(56) References Cited

U.S. PATENT DOCUMENTS

| | | | | |
|---|---|---|---|---|
| 8,610,519 | B2 | 12/2013 | Keimel et al. | |
| 8,659,326 | B1 | 2/2014 | Claydon et al. | |
| 2003/0012483 | A1* | 1/2003 | Ticknor et al. | 385/16 |
| 2007/0018761 | A1 | 1/2007 | Yamanaka et al. | |
| 2009/0159409 | A1 | 6/2009 | Keimel et al. | |
| 2010/0157858 | A1 | 6/2010 | Lee et al. | |
| 2011/0128112 | A1 | 6/2011 | Aimi et al. | |
| 2013/0028556 | A1 | 1/2013 | Cohen et al. | |
| 2014/0305777 | A1 | 10/2014 | Aimi et al. | |

FOREIGN PATENT DOCUMENTS

| | | | |
|---|---|---|---|
| EP | 2506282 | B1 | 10/2012 |
| JP | 2000149751 | A | 5/2000 |
| WO | 02075841 | A2 | 9/2002 |

OTHER PUBLICATIONS

De Los Santos et al., "Microwave and Mechanical Considerations in the Design of MEM Switches for Aerospace Applications", Aerospace Conference, 1997, Proceedings, IEEE Snowmass, Feb. 1, 1997, pp. 235-254, vol. No. 3.

Tan et al., "Low-Loss 2-and 4-Bit TTD MEMS Phase Shifters based on SP4T Switches", IEE Transactions on Microwave Theory and Techniques, IEE Service Center, Jan. 2003, pp. 297-304, vol. No. 51, Issue No. 1, Piscataway, NJ.

PCT Search Report and Written Opinion issued in connection with corresponding Application No. PCT/US2015/057308 on Jan. 26, 2016.

* cited by examiner

MULTICHANNEL RELAY ASSEMBLY WITH IN LINE MEMS SWITCHES

BACKGROUND

Aspects of the invention relate generally to devices for switching, and more particularly to multichannel relay assemblies containing multiple in line microelectromechanical system (MEMS) switch structures for use in a Radio Frequency application.

The aspirational technical specifications for the "ideal" switch in Radio Frequency (RF) applications have been held to be approximately: high isolation (off-state capacitance ($C_{off}$))=O fF; high linearity (IIP2 and IIP3→∞; medium or higher power handling (100 mW-1 kW); no insertion loss ($R_{on}$=0Ω) over a large frequency range; and, no dc power consumption.

Success at approaching this ideal RF switch has proved elusive. Electro mechanical relays, although large and expensive and a dated technology, still are a fairly successful attempt at a well performing RF switch. Other types of RF switch technologies have included p-i-n diode and GaAs FET switches. These too have shortcomings with certain RF applications.

More recently, attempts to use microelectromechanical system (MEMS) technologies, with actuators based on piezoelectric, electrostatic, thermal, or magneto-static designs, have been made. Using MEMs offers a mix of low cost fabrication along with some of the technical performance benefits of the mechanical relays. The RF MEMs switches use micromechanical movement to achieve an open or short circuit in the RF line(s).

Accordingly, there is an ongoing need for an RF application switch that addresses some, if not all, of the technical goals in the RF community for a high performing switch along with addressing other goals, such as ease of manufacturability.

BRIEF DESCRIPTION

According to an embodiment, an ohmic RF MEMS relay comprises: a substrate having a first capacitive coupling, $C_{sub}$; a first actuating element and a second actuating element electrically coupled in series, thereby defining a first channel, wherein the first and second actuating elements are configured to be independently actuated, further wherein the first and second actuating elements have a second capacitive coupling, $C_{gap}$; a midpoint on the first channel in electrical communication with the first and the second actuating element; and at least one anchor mechanically coupled to the substrate and supporting at least one of the first and second actuating elements.

According to another embodiment, an electrostatically control ohmic RF MEMS relay comprises: an input; an RF transmission line connecting the input to at least one output; a substrate having a first capacitive coupling, $C_{sub}$; a first actuating element and a second actuating element electrically coupled in series on the RF transmission line, wherein the first and second actuating elements are configured to be independently actuated, further wherein the first and second actuating elements have a second capacitive coupling, $C_{gap}$; a midpoint on the RF transmission line in electrical communication with the first and the second actuating element, wherein a potential of the midpoint serves as a common reference for a gating signal; at least one anchor mechanically coupled to the substrate and supporting at least one of the first and second actuating elements, wherein a ratio, $C_{sub}/C_{gap}$=r, wherein r<10, further wherein the relay is configured to operate in a first closed position and a second open position, wherein: the first closed position comprises electrically connecting the input and the at least one output; and the second open position comprises electrically disconnecting the input and the at least one output.

According to another embodiment, an ohmic RF MEMS relay comprises: an input port; a plurality of first MEMS switches defining a first switching group, the first switching group in electrical communication with the input port, thereby defining a plurality of channels each leading from each of the plurality of first MEMS switches; and at least one outlet port along each of the plurality of channels distal from the first switching group and in electrical communication with the input port.

According to another embodiment, an ohmic RF MEMS relay comprises: a substrate having a first capacitive coupling, $C_{sub}$; a first actuating element and a second actuating element electrically coupled in series, thereby defining a first channel, wherein the first actuating element and the second actuating element are configured to be simultaneously operated, further wherein the first and second actuating elements have a second capacitive coupling, $C_{gap}$; a midpoint on the first channel in electrical communication with the first and the second actuating element; and at least one anchor mechanically coupled to the substrate and supporting at least one of the first and second actuating elements.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1A:
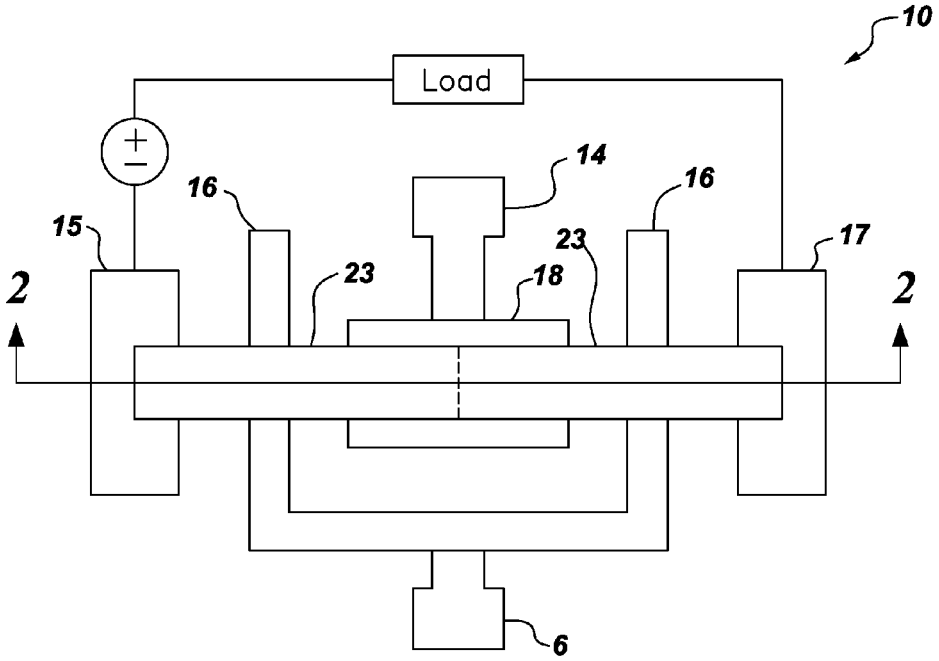
FIG. 1A is a schematic top view of a portion of a multichannel relay assembly in accordance with an exemplary embodiment.

Example embodiments of the present invention are described below in detail with reference to the accompanying drawings, where the same reference numerals denote the same parts throughout the drawings. Some of these embodiments may address some of the above and other needs.

Unless defined otherwise, technical and scientific terms used herein have the same meaning as is commonly understood by one of ordinary skill in the art with respect to the presently disclosed subject matter. The terms "first", "second", and the like, as used herein do not denote any order, quantity, or importance, but rather are used to distinguish one element from another. The terms "a", "an", and "the" do not denote a limitation of quantity, but rather denote the presence of at least one of the referenced item, and the terms "front", "back", "bottom", and/or "top", unless otherwise noted, are used for convenience of description only, and are not limited to any one position or spatial orientation.

If ranges are disclosed, the endpoints of all ranges directed to the same component or property are inclusive and independently combinable (e.g., ranges of "up to about 2.5 mm" is inclusive of the endpoints and all intermediate values of the ranges of "about 0 mm to about 2.5 mm," etc.). The modified "about" used in connection with a quantity is inclusive of the stated value and has the meaning dictated by the context (e.g., includes the degree of error associated with measurement of the particular quantity). Accordingly, the value modified by the term "about" is not necessarily limited only to the precise value specified.

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as well as their inflected forms as used in the present application, are intended to be synonymous unless otherwise indicated.

The term MEMS generally refers to micron-scale structures that can integrate a multiplicity of functionally distinct elements such as mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, for example, structures that may be smaller than 100 nanometers in size. Accordingly, even though example embodiments described throughout this document may refer to MEMS-based switching devices, it is submitted that the embodiments should be broadly construed and should not be limited to only micron-sized devices unless otherwise limited to such.

Documentation pertinent to MEMS technologies, having common assignee, includes U.S. Pat. Nos. 7,928,333; 8,354,899; 8,610,519; and, 8,779,886. These documents are hereby incorporated by reference in their entirety.

Embodiments of the present invention comprise a multiple channel relay assembly having in line MEMS switches for an RF application. From an RF input port, multiple outputs can be switched on/off to ensure channel isolation as well as good insertion loss for the selected (i.e., on) channel. By providing additional switches in the assembly close to the RF input port, the RF signal is propagated in the desired direction while minimizing RF leakages.

It has been discovered that embodiments of the present invention provide certain advantages including, for example, better insertion loss, lower dispersive leakage, and lower return loss. The design methodology offers performance improvements for high power applications in particular.

Figure 1B:
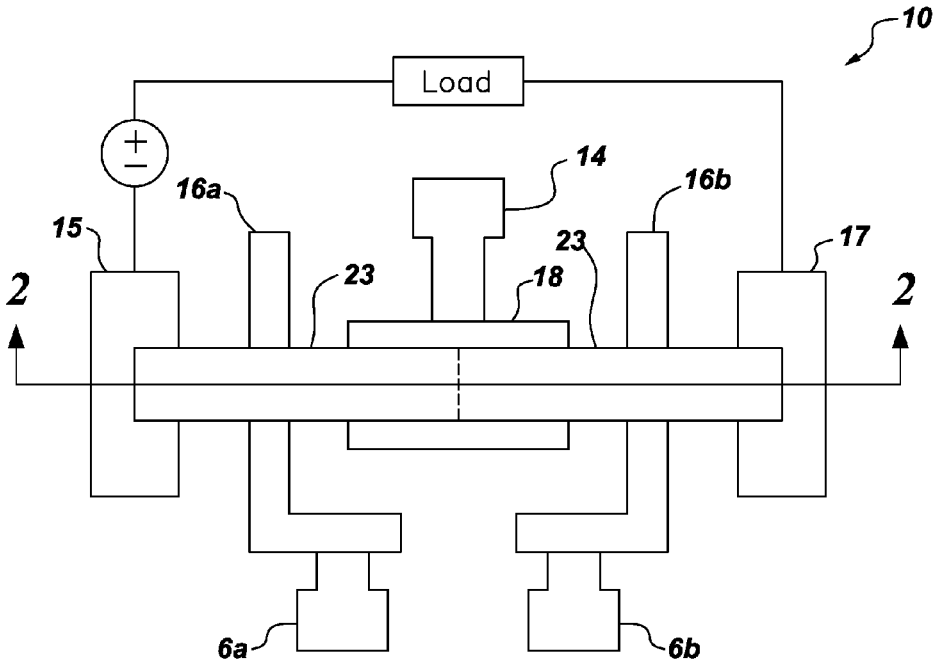
FIG. 1B is a schematic top view of a portion of a multichannel relay assembly in accordance with another exemplary embodiment.
Figure 2:
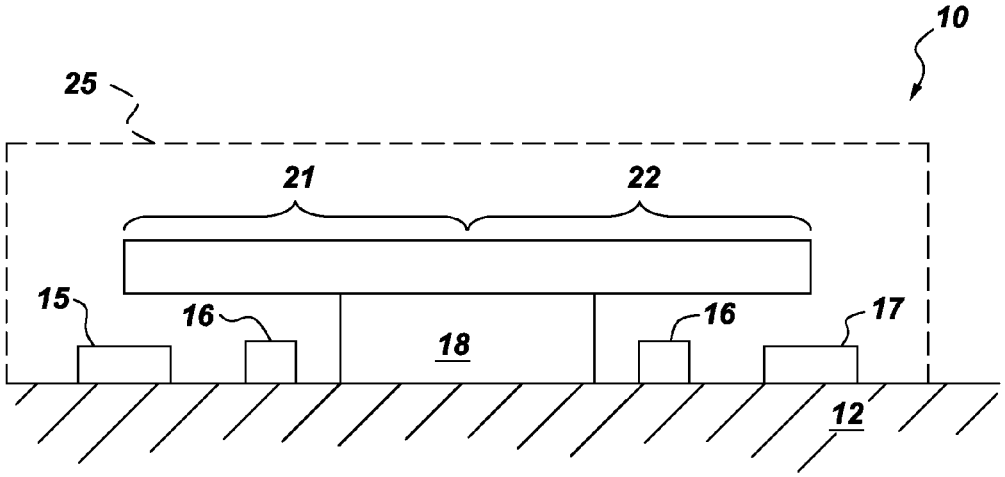
FIG. 2 is a side elevation view along line 2-2 of the portion of the multichannel relay assembly in FIGS. 1A and/or 1B.

FIGS. 1A and 1B are a schematics illustrating top down views of two embodiments of a MEMS switch. FIG. 1A is an embodiment where the actuating elements are simultaneously activated; FIG. 1B is an embodiment where the actuating elements may be independently activated. FIG. 2 is a cross-sectional view of the MEMS switch 10 of FIGS. 1A and 1B taken across section line 2 as shown. In the illustrated embodiment, MEMS switch 10 is supported by an underlying substrate 12. The substrate 12 provides support to the MEMS switch and may represent a rigid substrate formed from silicon, germanium, or fused silica, for example, or the substrate 12 may represent a flexible substrate such as that formed from a polyimide for example. Moreover, the substrate 12 may be conductive or may be insulating. In embodiments where the substrate 12 is conductive, an additional electrical isolation layer (not shown) may be included between the substrate 12 and the MEMS switch contacts, anchor and gate (described below) to avoid electrical shorting between such components.

The MEMS switch 10 includes a first contact 15 (sometimes referred to as a source or input contact), a second contact 17 (sometimes referred to as a drain or output contact), and a movable actuator 23. In one embodiment, the movable actuator 23 is conductive and may be formed from any conductive material or alloy. In one embodiment, the contacts (15, 17) may be electrically coupled together as part of a load circuit and the movable actuator 23 may function to pass electrical current from the first contact 15 to the second contact 17 upon actuation of the switch. As illustrated in FIG. 2, the movable actuator 23 may include a first actuating element 21 configured to make an electrical connection with the first contact 15 and a second actuating element 22 configured to make an electrical connection with the second contact 17. In one embodiment, the first and second actuating elements may be independently actuated depending upon the attraction force applied to each actuating element (See e.g., FIG. 1B). In another embodiment, the first and second actuating elements may be simultaneously attracted toward the substrate 12 during actuation (described further below) (See e.g., FIG. 1A). In one embodiment, the first and second actuating elements are integrally formed as opposite ends of actuating elements that share the same anchor region and are electrically conductive. In an alternative embodiment, the first and second actuating elements may be electrically coupled through additional internal or external electrical connections. By integrating the first and second actuating elements as part of the same movable actuator, external connections may be eliminated thereby reducing the overall inductance of the device and minimizing the capacitive coupling to the substrate.

As illustrated in FIGS. 1A, 1B, and FIG. 2, the movable actuator 23 (including the first actuating element 21 and the second actuating element 22) may be supported and mechanically coupled to the substrate 12 by one or more anchors 18. In one embodiment, the movable actuator 23 may also be electrically coupled to the anchor(s) 18. In an embodiment where a single anchor 18 is used to support both the first actuating element 21 and the second actuating element 22, it may be desirable for the anchor 18 to be sufficiently wide (in a direction extending between the first and second contacts) such that any strain or inherent stresses associated with one actuating element are not transferred or mechanically coupled to the second actuating element. Moreover, in an embodiment where a single anchor 18 is used to support both the first actuating element 21 and the second actuating element 22, the distance of the fixed material between the movable actuating elements may be greater than the combined length of the moveable elements.

The MEMS switch 10 in FIG. 1A includes a common gate 16 controlled by a single gate driver 6 and configured to contemporaneously impart an attraction force upon both the first and second actuating elements 21 and 22. Contrastingly, the MEMS switch 10 in FIG. 1B includes two gates 16*a*, 16*b* each individually controlled by their own respective gate drivers 6*a*, 6*b* and configured to independently impart an attraction force upon the first and second actuating elements 21 and 22. Such attraction force may be embodied as an electrostatic force, magnetic force, a piezo-resistive force or as a combination of forces. In an electrostatically actuated switch, the gate 16 may be electrically referenced to the switch reference 14, which in FIG. 1A and FIG. 2 is at the same electrical potential as the conduction path of the movable actuator 23 when the switch is in the closed state. In a magnetically actuated switch, a gating signal, such as a voltage, is applied to change the magnetic state of a material to provide or eliminate a presence of a magnetic field which drives the moveable elements. Similarly, a gating signal such as a voltage can be applied to a piezoresistive material spanning the moveable elements to induce actuation. In the case of both magnetic and piezo-resistive actuation, the gating signal does not create an electrostatic attractive force between the moveable elements and therefore does not need to be referenced to the moveable elements.

In one embodiment, the gate driver 6 includes a power supply input (not shown) and a control logic input that provides a means for changing the actuation state of the MEMS switch. In one embodiment, the gating voltage is referenced to the moveable actuating elements 21 and 22 and the differential voltages between the two contacts and respective movable elements are substantially equal. In one embodiment, the MEMS switch 10 may include a resistive or capacitive grading network (not shown) coupled between the contacts and the switch reference 14 to maintain the switch reference 14 at a potential that is less than the self-actuation voltage of the switch.

By sharing a common gating signal in the MEMS switch 10, a large actuation voltage that may otherwise surpass the actuation voltage for a conventional MEMS switch, would be shared between the first actuating element and the second actuating element. For example, in the MEMS switch 10 of FIG. 1A and FIG. 2, if a voltage of 200 v was placed across the first contact 15 and the second contact 17, and the switch reference 14 was graded to 100 v, the voltage between the first contact 15 and the first actuating element 21 would be approximately 100 v while the voltage between the second contact 17 and the second actuating element 22 would also be approximately 100 v.

In FIG. 2, the MEMS switch 10 further includes a cap 25 that forms a hermetic seal with the substrate 12 around the components of MEMS switch 10 including both actuating elements 21 and 22. Typically, many MEMS switches are formed on a single substrate. These switches are then capped and singulated or diced. In one embodiment, the first and second actuating element and the common gate 16 of MEMS switch 10 are formed and capped on a single die. By including the first and second actuating elements within a single cap, it is possible to increase the standoff voltage of the MEMS switch without substantially increasing the switch footprint. For example, the standoff voltage of the switch effectively can be doubled, while the overall switch footprint is only increased slightly more than that of a single switch.

Figure 3:
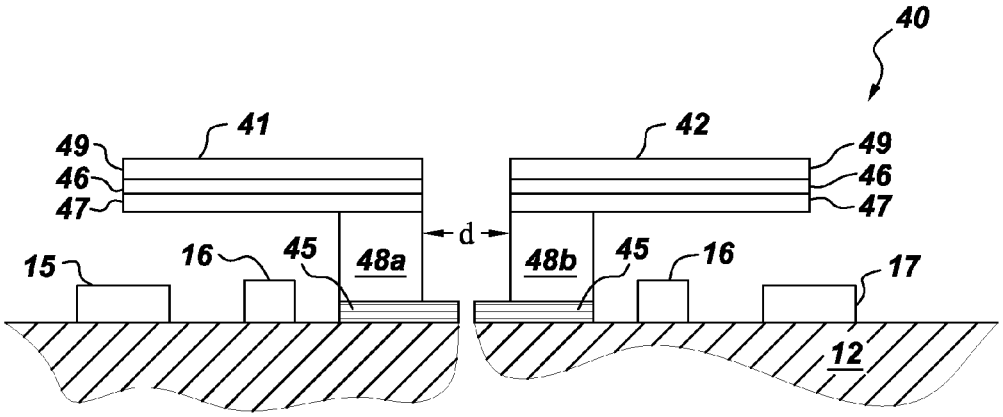
FIG. 3 is a schematic side elevation view of a portion of a multichannel relay assembly in accordance with another exemplary embodiment.

FIG. 3 is a schematic illustrating one embodiment of a MEMS switch in which a first actuating element and a second actuating element are physically separated, by a distance "d". As shown, MEMS switch 40 may include a first actuating element 41 supported by a first anchor 48*a* and a second actuating element 42 supported by a second anchor 48*b*. In an alternative embodiment, the first actuating element 41 and the second actuating element 42 may be supported by a single anchor while maintaining separation between the actuating elements. In the illustrated embodiment, the first and the second actuating elements may each include electrical biasing components 47 isolated from the conduction path 49 of the respective actuating element by an isolation region 46. The electrical biasing component 47 may represent a conductive layer or trace formed as part of the actuating element in a MEMS photolithographic fabrication process or a piezo-resistive material configured to impart and mechanical force on a respective actuating element. In one embodiment, the conduction paths 49 of each the actuating elements 41 and 42 may be electrically coupled by electrical connection, or first channel, 45. Although not shown, MEMS switch 40 may also be capped as was described with respect to MEMS switch 10. As will be discussed herein the distance "d" may be lengthened in embodiments such that MEMS switches 40 are placed distally from each other in various combinations. That is a combination of orientation of the MEMS switches 40 and various channel(s) 45 there between, along with a unique selection of materials of both channel(s), substrates, and/or switches 40, results in an improved multichannel relay assembly for RF applications.

Referring collectively to FIGS. 3 and 4A-4C, the relay assembly 40, 110, 210, 310 may comprise a substrate 12 having a first capacitive coupling, $C_{sub}$. At least a first actuating elements 41, 140, 240, 340 and a second actuating element 42, 140, 240, 340 are electrically connected in series so as to define a first channel 45, 130, 230, 330. The first actuating elements 41, 140, 240, 340 and second actuating element 42, 140, 240, 340 are configured to be either independently actuated or configured to be operated simultaneously when referenced to a common controlling signal. The first actuating elements 41, 140, 240, 340 and second actuating element 42, 140, 240, 340 have second capacitive coupling, $C_{gap}$ or $C_g$. At least one anchor 48*a*, 48*b*, 120, 220, 320 is mechanically coupled to the substrate 12 and supporting at least one of first actuating elements 41, 140, 240, 340 a second actuating element 42, 140, 240, 340.

Figure 4A:
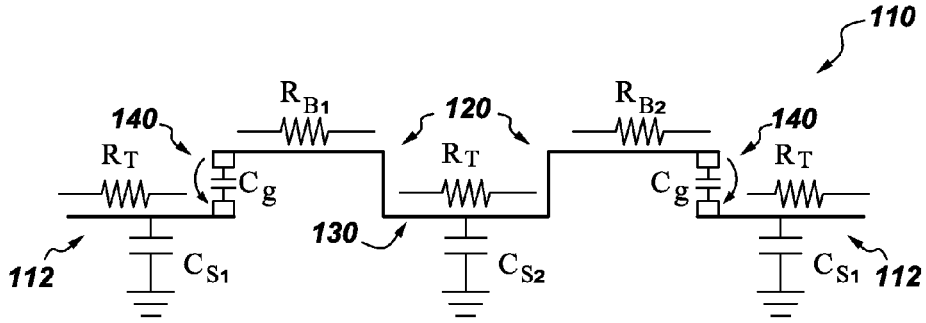
FIGS. 4A-4C are electrical diagrams of side elevation views of portions of multichannel relay assemblies in accordance with three exemplary embodiments.
Figure 4B:
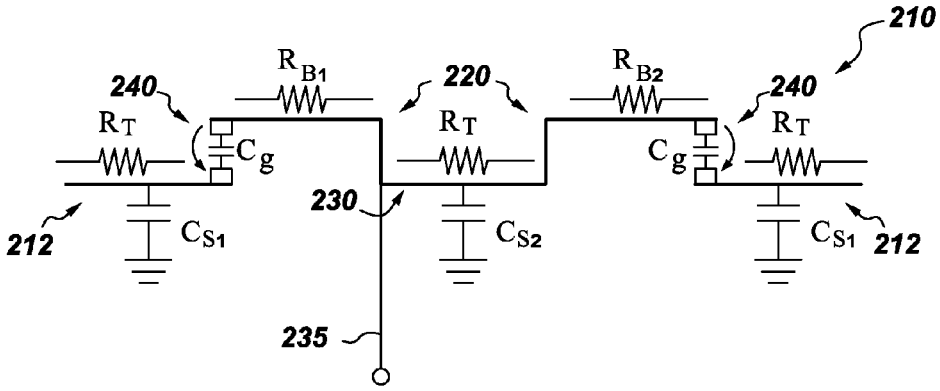
Figure 4C:
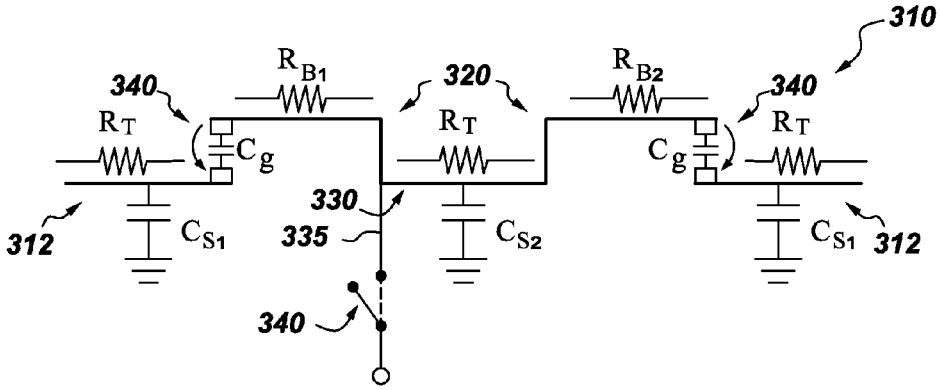

As shown in FIGS. 4A-4C the trace-to-substrate capacitance is shown as $C_{s2}$ and the switch-to-substrate capacitance is shown as $C_{s1}$. In embodiments, $C_{s1}=C_{s2}$ and in other embodiments $C_{s1} \neq C_{s2}$. The capacitive coupling of the actuating elements across the gap is shown as $C_g$.

Figure 5A:
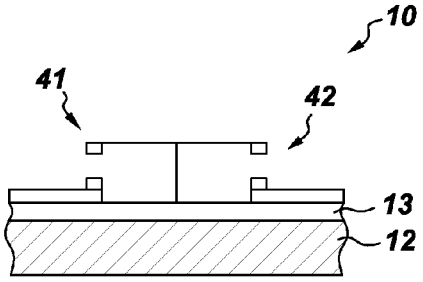
FIGS. 5A and 5B are schematic side elevation views of a portion of a multichannel relay assembly in accordance with other exemplary embodiments.
Figure 5B:
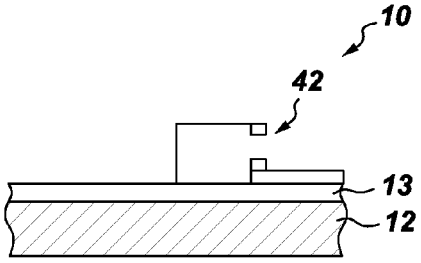

Referring to FIGS. 5A and 5B, embodiments of other MEMS switches 10 are illustrated. As depicted, MEMS switch 10 in FIG. 5A has two actuating elements 41, 42 sharing a common anchor or a common anchor potential and is sometimes termed a "back-to-back" configuration. Contrastingly, MEMS switch 10 in FIG. 5A has a single actuating element 41.

Figure 6:
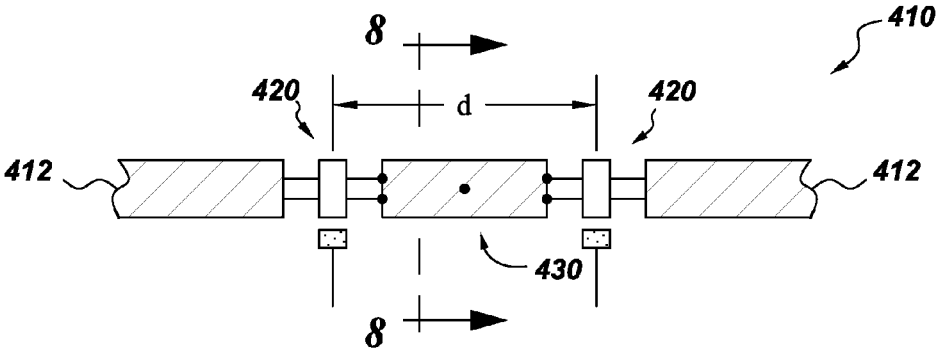
FIG. 6 is a schematic top view of a portion of a multichannel relay assembly in accordance with an exemplary embodiment.
Figure 7:
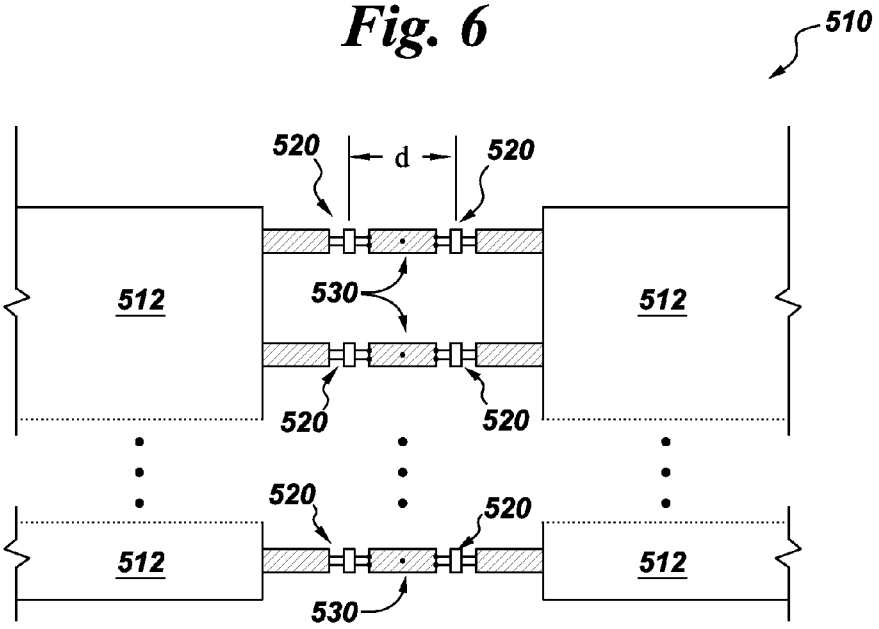
FIG. 7 is a schematic top view of a portion of a multichannel relay assembly in accordance with another exemplary embodiment.

Referring to FIGS. 6 and 7, a midpoint on the first channel (shown as a "dot") 430, 530 is in electrical communication with the first and second actuating element 420, 520. The assembly is configured as an ohmic RF MEMS relay. The potential of the midpoint may serve as a common reference for a gating signal. The gating signal may be configured to activate one, or more, actuating elements at a time. That is the MEMS switches 420, 520 may be activated simultaneously or independently.

The material, or combination of materials, and/or configuration of the assembly is such that a ratio $C_{sub}/C_{gap}=r$, such than $r<10$. In some embodiments, r can be smaller than 1.

Referring back to FIGS. 4B and 4C, the relay assembly 210, 310 may comprise a reference isolation 235, 335 along the first channel 230, 330. In an embodiment, the reference isolation may further comprise a switch 340 (FIG. 4C).

Referring to FIGS. 6 and 7, the relay assembly 410, 510 may comprise a single (first) channel 430 having two or more switches 420 in series, or as shown in FIG. 7, there may be a plurality of channels 530 in a parallel configuration wherein each channel 530 has a plurality of switches 520 in series. As depicted, the channels 530 share a common channel 512 in parallel.

Figure 8:
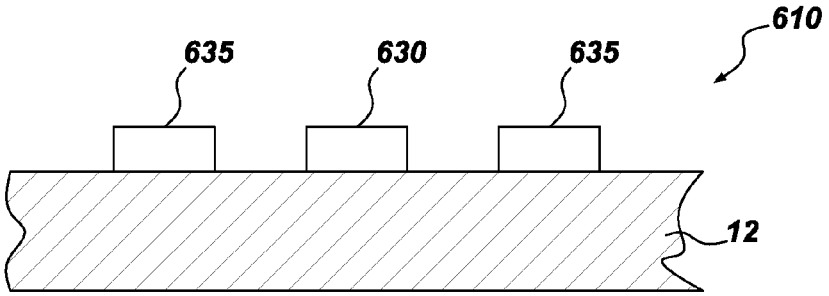
FIG. 8 is an end elevation view along line 8-8 of the portion of the multichannel relay assembly in FIG. 6.
Figure 9:
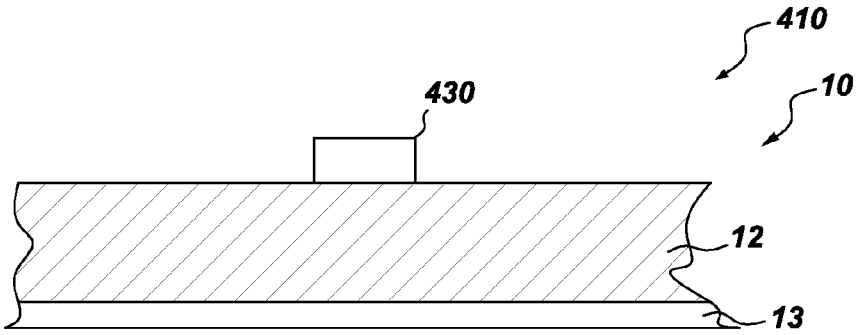
FIG. 9 is an end elevation view along of a portion of the multichannel relay assembly in accordance with another exemplary embodiment.
Figure 10:
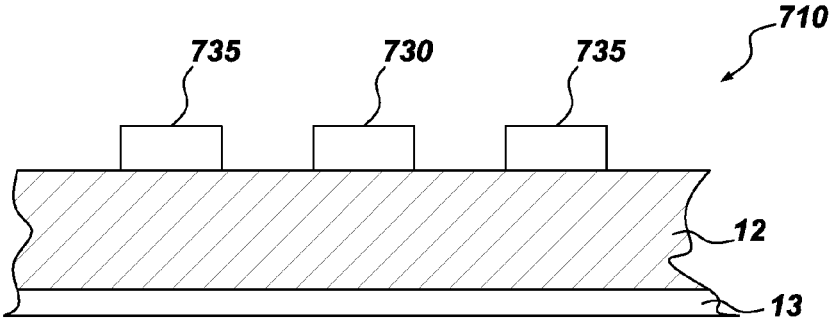
FIG. 10 is an end elevation view along of a portion of the multichannel relay assembly in accordance with another exemplary embodiment.

Referring collectively to FIGS. 8-10, the embodiments 610, 410, 710 may have variety of first channel 630, 430, 730 and substrate 12 configurations. It should be noted that in some of the other figures depicted various grounding channels or lines are not shown for clarity purposes only (See e.g., FIGS. 6, 7, 11). It should be noted that electrical isolation between the signal and ground traces is not shown for clarity purposes. Isolation can be achieved through both thin film layers as well as through the use of an insulating substrate. FIGS. 8-10 show a variety of grounding configurations available. FIG. 8, for example, depicts a coplanar waveguide configuration. As shown, the signal channel 630 has two coplanar ground lines 635 on either side of the signal channel 630, all collectively on the substrate 12. Similarly, FIG. 10 shows a grounded coplanar waveguide configuration wherein two ground lines 735 are coplanar to the signal channel 730. The embodiment 710 has an additional ground layer 13 below the substrate 12. FIG. 8 depicts an embodiment 410 having a microstrip configuration. As shown, the signal channel 430 is on the substrate and a ground layer 13 is below the substrate.

Figure 11:
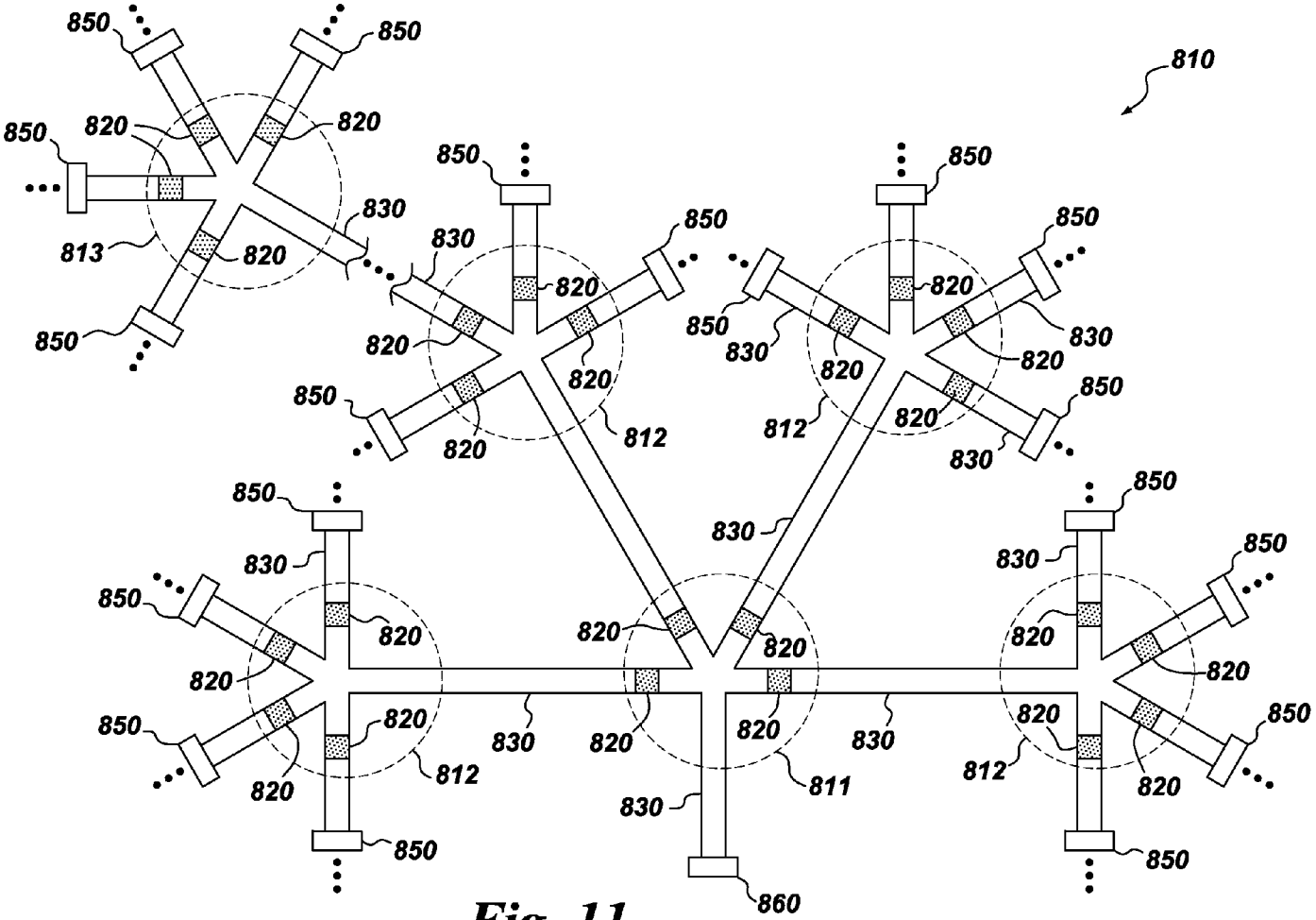
FIG. 11 is a schematic plan view along a multichannel relay assembly in accordance with another exemplary embodiment.

Referring to FIG. 11, a schematic top view of a multichannel relay assembly 810 configured in accordance with an embodiment of the present invention is depicted. The multichannel relay assembly 810 may comprise an RF input, or input port, 860 and a plurality of outlet ports, or ports, 850, thereby defining a plurality of channels 830. Each of the plurality of channels 830 will include at least one MEMS switch 820 located a distance between the RF input 860 and the port 850. In order to provide both improved insertion loss and good isolation (e.g., at 12 GHz>30 dB) in the assembly 810, it has been discovered that each of the plurality of MEMS switches 820 should be located as close as practical to the RF input 860. For example, in an embodiment, the distance between the MEMS switches 820 and the RF input 860 should be $\leq\lambda/4$. MEMS switches 820 comprise any suitable MEMS switch embodiments as discussed herein, as well as any now known or later developed MEMS technology switch.

In addition to minimizing distance between RF input 860 and MEMS switches 820, another feature in certain embodiments of the present invention is to have symmetry between the plurality of channels 830 each extending from the RF input 860 and the MEMS switches 820 and the ports 850 beyond. That is, the distance of each channel length should desirably be of equal, or about equal, length in each channel. While symmetry is desirable to maintain equivalent performance across all channels, symmetry is not required and can be traded off for both slight inconsistencies in both insertion loss and isolation.

The assembly 810 may be used, typically, for RF applications (e.g., MHz-GHz). Further, the MEMS switches 820 typically are located so that the anchor of the MEMS switch 820 "faces" towards the RF input 860

Referring to the particular embodiment shown in FIG. 11, the assembly 810 includes a first switching group 811 comprising a plurality of MEMS switches 820 (e.g., four). The first switching group 811 is in electrical communication with the input port 860. The entire assembly 100 may be integrated into a single, monolithic housing. The entire 4-throw assembly 100 housing may be, for example, about 1.2 mm across in dimension. At least one channel 830 extends from each of the plurality of first MEMS switches 820 in the first switching group 811.

In should be apparent that while four MEMS switches 820 are shown in the first switching group 811 in FIG. 11, other configurations are possible without departing from aspects of the present invention. There may be a different quantity of MEMS switches 820 than the quantity shown. The quantity of MEMS 820 switches may meet, or exceed, the quantity of channels 830 provided.

Referring further to the particular embodiment shown in FIG. 11, the assembly 810 shows a 16-throw assembly 810 that has sixteen channels 830 each having two MEMS switch 820 per channel. The entire assembly 810 may be housed in a housing or device. The entire 16-throw assembly 810 housing may be, for example, about 1.2 mm across in dimension. In should be apparent that while twenty MEMS switches 820 in total are shown in FIG. 11, other configurations are possible without departing from aspects of the present invention, there may be a different quantity of MEMS switches 820 than the quantity shown. The quantity of MEMS 820 switches should meet, or exceed, the quantity of channels 830.

As shown, the assembly 810 comprises a first switching group 811 and a plurality of second switching groups 812. Extending from the first MEMS group 811 are four channels 830 each extending to a second switching group 812. Each of the switching groups 811, 812 comprise a plurality (e.g., four) MEMS switches 820 ultimately leading to the output port 850 via channels 830. Thus, the first four MEMS switches 820 in the first switching group 811 may be located as close to the RF input 860 as practical. Each channel extending 830 from each of the first four MEMS switches 820 extends to the second switching groups 812 and to output ports 850 beyond. Thus, the first set of MEMS switches 820 are integrated into a first MEMS group 811. The second set of MEMS switches 820 are integrated, in the embodiment shown, into four separate MEMS groups 812. Each of the channels 830 is constructed to be of equal, or about equal, length. As shown, the channels 830 are constructed to be symmetrical, or about symmetrical.

Further, as the dotted lines (•••) extending from each output port 850 indicate, in embodiments additional channels 830 could further extend to additional switch groups and/or MEMS switches (not shown). That is, while a 16 throw relay is depicted, clearly other quantities of outputs 850 could be envisioned, up to a quantity of outputs approaching n, wherein $n \rightarrow \infty$. As an example, in FIG. 11 a third switching group 813 comprising a plurality of MEMS switches 820 (e.g., four) extending from a channel 830 to connote the possibility of adding additional switch groups, MEMS switches, and channels, as desired.

As discussed herein, in certain embodiments, the channels 830 may be bidirectional. As such, it should be noted that although the embodiments illustrated herein may show a single RF input 860 connected to a plurality of exit ports 850 (e.g., 1-to-4, 1-to-16, etc.), due to the bidirectional capability of ohmic MEMS relays other configurations are possible. For example, the single RF inputs 860 could be exit ports in certain embodiments, while the plurality of exit ports 850 could be inputs. Thus, in certain embodiments, the assembly 810 may consist of a plurality of inputs connected to a single exit ports (e.g., 4-to-1, 16-to-1, etc.), and the like.

$C_{gap}$, or the capactive coupling from the beam to trace, can vary from about 3 to about 20 fF, across a channel. By way of illustration only, the $C_{gap}$ for a variety of designs can include: SPST with a single beam about 4.4 fF; SPST with a double beam about 7.0 fF; SPST with a triple beam about 9.0 fF; and, SPST with four beams about 11.0 fF.

The quantity of beams may vary from 1 to about 20.

The substrate 12 may be comprised of any suitable material, or combination of materials, that have low permittivity and high resistance. For example, suitable substrates may comprise materials such as silicon, polyimide, quartz, fused silica, glass, sapphire, aluminum oxide, and the like. In general, the substrate may have a permittivity $\epsilon<20$. In other embodiments, the permittivity $\epsilon<10$. In an embodiment, the substrate 12 may include a coating or plurality of coatings. For example a coating of $Si_3N_4$ is on a Si layer thereby forming the substrate 12.

According to an embodiment, an ohmic RF MEMS relay comprises: a substrate having a first capacitive coupling, $C_{sub}$; a first actuating element and a second actuating element electrically coupled in series, thereby defining a first channel, wherein the first and second actuating elements are configured to be independently actuated, further wherein the first and second actuating elements have a second capacitive coupling, $C_{gap}$; a midpoint on the first channel in electrical communication with the first and the second actuating element; and at least one anchor mechanically coupled to the substrate and supporting at least one of the first and second actuating elements.

According to another embodiment, an electrostatically control ohmic RF MEMS relay comprises: an input; an RF transmission line connecting the input to at least one output; a substrate having a first capacitive coupling, $C_{sub}$; a first actuating element and a second actuating element electrically coupled in series on the RF transmission line, wherein the first and second actuating elements are configured to be independently actuated, further wherein the first and second actuating elements have a second capacitive coupling, $C_{gap}$; a midpoint on the RF transmission line in electrical communication with the first and the second actuating element, wherein a potential of the midpoint serves as a common reference for a gating signal; at least one anchor mechanically coupled to the substrate and supporting at least one of the first and second actuating elements, wherein a ratio, $C_{sub}/C_{gap}=r$, wherein $r<10$, further wherein the relay is configured to operate in a first closed position and a second open position, wherein: the first closed position comprises electrically connecting the input and the at least one output; and the second open position comprises electrically disconnecting the input and the at least one output.

According to another embodiment, an ohmic RF MEMS relay comprises: an input port; a plurality of first MEMS switches defining a first switching group, the first switching group in electrical communication with the input port, thereby defining a plurality of channels each leading from each of the plurality of first MEMS switches; and at least one outlet port along each of the plurality of channels distal from the first switching group and in electrical communication with the input port.

According to another embodiment, an ohmic RF MEMS relay comprises: a substrate having a first capacitive coupling, $C_{sub}$; a first actuating element and a second actuating element electrically coupled in series, thereby defining a first channel, wherein the first actuating element and the second actuating element are configured to be simultaneously operated, further wherein the first and second actuating elements have a second capacitive coupling, $C_{gap}$; a midpoint on the first channel in electrical communication with the first and the second actuating element; and at least one anchor mechanically coupled to the substrate and supporting at least one of the first and second actuating elements.

While only certain features of the invention have been illustrated and/or described herein, many modifications and changes will occur to those skilled in the art. Although individual embodiments are discussed, the present invention covers all combination of all of those embodiments. It is understood that the appended claims are intended to cover all such modification and changes as fall within the intent of the invention.

What is claimed:

1. An ohmic RF MEMS relay comprising:

a substrate having a first capacitive coupling, $C_{sub}$;

a first actuating element and a second actuating element electrically coupled in series, thereby defining a first channel, wherein the first and second actuating elements are configured to be independently actuated, further wherein the first and second actuating elements have a second capacitive coupling, $C_{gap}$;

a midpoint on the first channel in electrical communication with the first and the second actuating element; and at least one anchor mechanically coupled to the substrate and supporting at least one of the first and second actuating elements.

2. The ohmic RF MEMS relay of claim 1, wherein a ratio, $C_{sub}/C_{gap}=r$, wherein $r<10$.

3. The ohmic RF MEMS relay of claim 1, wherein a potential of the midpoint serves as a common reference for a gating signal.

4. The ohmic RF MEMS relay of claim 1, wherein the at least one anchor comprises a common anchor shared by the first actuating element and the second actuating element.

5. The ohmic RF MEMS relay of claim 1, wherein the at least one anchor comprises a first anchor supporting the first actuating element and a second anchor supporting the second actuating element, wherein the first anchor and the second anchor are not mechanically coupled to each other.

6. The ohmic RF MEMS relay of claim 1, further comprising a third actuating element in electrically coupled in series with at least one of the first and the second actuating element, thereby defining a second channel.

7. The ohmic RF MEMS relay of claim 1, wherein the first actuating element and the at least one anchor comprise a first MEMS switch; and, the second actuating element and the at least one anchor comprise a second MEMS switch.

8. The ohmic RF MEMS relay of claim 1, further comprising an input port, wherein a distance between the input port and the first actuating element is less than about $\lambda/4$, wherein $\lambda$ comprises a wavelength.

9. The ohmic RF MEMS relay of claim 1, further comprising at least one gate driver configured to provide a gating signal to actuate at least one of the first and the second actuating elements.

10. The ohmic RF MEMS relay of claim 1, further comprising an input port and a plurality of output ports.

11. An ohmic RF MEMS assembly comprising a plurality of the RF MEMS relay of claim 1 in electrical communication with each other.

12. The ohmic RF MEMS relay of claim 1, further comprising a reference isolation along the first channel.

13. The ohmic RF MEMS relay of claim 1, the first channel comprising a coplanar waveguide.

14. The ohmic RF MEMS relay of claim 1, the first channel comprising a signal line and further comprising a ground layer below the substrate, the ground layer and first channel defining one of a microstrip configuration and a grounded coplanar waveguide configuration.

15. The ohmic RF MEMS relay of claim 1, wherein a distance along the first channel from at least one of the first actuating element and the second actuating element to the midpoint is at least about 0.25 mm.

16. The ohmic RF MEMS relay of claim 2, further wherein $r<1$.

17. The ohmic RF MEMS relay of claim 6, wherein the first channel and the second channel are electrically coupled in a parallel configuration.

18. The ohmic RF MEMS relay of claim 6, wherein at least two of the first, second, and third actuating elements are in a parallel configuration.

19. The ohmic RF MEMS relay of claim 9, wherein the at least one gate driver is referenced to at least two actuating elements.

20. The ohmic RF MEMS relay of claim 12, the reference isolation further comprising a switch.

21. The ohmic RF MEMS relay of claim 13, further comprising MEMS switches on a plurality of ground lines of the coplanar waveguide.

22. An electrostatically control ohmic RF MEMS relay comprising:

an input;

an RF transmission line connecting the input to at least one output;

a substrate having a first capacitive coupling, $C_{sub}$;

a first actuating element and a second actuating element electrically coupled in series on the RF transmission line, wherein the first and second actuating elements are configured to be independently actuated, further wherein the first and second actuating elements have a second capacitive coupling, $C_{gap}$;

a midpoint on the RF transmission line in electrical communication with the first and the second actuating element, wherein a potential of the midpoint serves as a common reference for a gating signal;

at least one anchor mechanically coupled to the substrate and supporting at least one of the first and second actuating elements, wherein a ratio, $C_{sub}/C_{gap}=r$, wherein $r<10$, further wherein the relay is configured to operate in a first closed position and a second open position, wherein:

the first closed position comprises electrically connecting the input and the at least one output; and the second open position comprises electrically disconnecting the input and the at least one output.

23. The electrostatically control ohmic RF MEMS relay of claim 22, wherein the first actuating element and a second actuating element are comprised substantially of metal.

24. An ohmic RF MEMS relay comprising:

an input port;

a plurality of first MEMS switches defining a first switching group, the first switching group in electrical communication with the input port, thereby defining a plurality of channels each leading from each of the plurality of first MEMS switches;

at least one outlet port along each of the plurality of channels distal from the first switching group and in electrical communication with the input port; and a second switching group comprising a plurality of second MEMS switches, wherein the second switching group is along one of the plurality of channels between first switching group and the at least one outlet port, thereby in electrical communication with the input port.

25. The ohmic RF MEMS relay of claim 24, wherein the second switching group comprises a plurality of switching groups, wherein a quantity of the plurality of switching groups is equal to a quantity of the plurality of channels leaving the first switching group.

26. An ohmic RF MEMS relay comprising:

a substrate having a first capacitive coupling, $C_{sub}$;

a first actuating element and a second actuating element electrically coupled in series, thereby defining a first channel, wherein the first actuating element and the second actuating element are configured to be simultaneously operated, further wherein the first and second actuating elements have a second capacitive coupling, $C_{gap}$;

a midpoint on the first channel in electrical communication with the first and the second actuating element; and at least one anchor mechanically coupled to the substrate and supporting at least one of the first and second actuating elements.

27. The ohmic RF MEMS relay of claim 26, wherein a ratio, $C_{sub}/C_{gap}=r$, wherein $r<10$.

28. The ohmic RF MEMS relay of claim 26, wherein a potential of the midpoint serves as a common reference for a gating signal.

29. The ohmic RF MEMS relay of claim 26, wherein the at least one anchor comprises a common anchor shared by the first actuating element and the second actuating element.

30. The ohmic RF MEMS relay of claim 26, wherein the at least one anchor comprises a first anchor supporting the first actuating element and a second anchor supporting the second actuating element, wherein the first anchor and the second anchor are not mechanically coupled to each other.

31. The ohmic RF MEMS relay of claim 26, further comprising a third actuating element in electrically coupled in series with at least one of the first and the second actuating element, thereby defining a second channel.

32. The ohmic RF MEMS relay of claim 26, wherein the first actuating element and the at least one anchor comprise a first MEMS switch; and, the second actuating element and the at least one anchor comprise a second MEMS switch.

33. The ohmic RF MEMS relay of claim 26, further comprising an input port, wherein a distance between the input port and the first actuating element is less than about $\lambda/4$, wherein $\lambda$ comprises a wavelength.

34. The ohmic RF MEMS relay of claim 26, further comprising at least one gate driver configured to provide a gating signal to actuate at least one of the first and the second actuating elements.

35. The ohmic RF MEMS relay of claim 26, further comprising an input port and a plurality of output ports.

36. An ohmic RF MEMS assembly comprising a plurality of the RF MEMS relay of claim 26 in electrical communication with each other.

37. The ohmic RF MEMS relay of claim 26, further comprising a reference isolation along the first channel.

38. The ohmic RF MEMS relay of claim 26, the first channel comprising a coplanar waveguide.

39. The ohmic RF MEMS relay of claim 26, the first channel comprising a signal line and further comprising a ground layer below the substrate, the ground layer and first channel defining one of a microstrip configuration and a grounded coplanar waveguide configuration.

40. The ohmic RF MEMS relay of claim 26, wherein a distance along the first channel from at least one of the first actuating element and the second actuating element to the midpoint is at least about 0.25 mm.

41. The ohmic RF MEMS relay of claim 27, further wherein $r<1$.

42. The ohmic RF MEMS relay of claim 31, wherein the first channel and the second channel are electrically coupled in a parallel configuration.

43. The ohmic RF MEMS relay of claim 31, wherein at least two of the first, second, and third actuating elements are in a parallel configuration.

44. The ohmic RF MEMS relay of claim 34, wherein the at least one gate driver is referenced to at least two actuating elements.

45. The ohmic RF MEMS relay of claim 37, the reference isolation further comprising a switch.

46. The ohmic RF MEMS relay of claim 38, further comprising MEMS switches on a plurality of ground lines of the coplanar waveguide.

* * * * *